US007442133B2

(12) United States Patent
Wolf

(10) Patent No.: US 7,442,133 B2
(45) Date of Patent: Oct. 28, 2008

(54) SHOOTING AND TRAINING AID FOR BASKETBALL PLAYERS

(75) Inventor: Jay W. Wolf, New Richmond, WI (US)

(73) Assignee: Star Shooter Company, LLC, New Richmond, WI (US)

( * ) Notice: Subject to any disclaimer, the term of this patent is extended or adjusted under 35 U.S.C. 154(b) by 365 days.

(21) Appl. No.: 11/436,542

(22) Filed: May 19, 2006

(65) Prior Publication Data

US 2007/0270247 A1 Nov. 22, 2007

(51) Int. Cl.
*A63B 69/00* (2006.01)

(52) U.S. Cl. ..... 473/450; 482/124

(58) Field of Classification Search ..... 473/450, 473/61, 422, 446, 464, 458, 459; 2/161.1; 482/124, 125

See application file for complete search history.

(56) References Cited

U.S. PATENT DOCUMENTS

| | | | | |
|---|---|---|---|---|
| 2,709,257 | A | 5/1955 | McKinney | |
| 3,640,532 | A | 2/1972 | Bauer | |
| 3,707,730 | A | 1/1973 | Slider | |
| 3,820,783 | A | 6/1974 | Caveness | |
| 3,858,876 | A | 1/1975 | Williams | |
| 3,880,426 | A | 4/1975 | Morse | |
| 4,377,284 | A | 3/1983 | Okerlin | |
| 4,383,685 | A | 5/1983 | Bishop | |
| 4,579,341 | A | 4/1986 | Furr | |
| 4,919,425 | A * | 4/1990 | Wolf | 473/450 |
| 5,135,217 | A | 8/1992 | Swain | |
| 5,188,356 | A | 2/1993 | Furr et al. | |
| 5,228,682 | A * | 7/1993 | Wolf | 473/450 |
| 5,320,342 | A | 6/1994 | Houck | |
| 5,816,952 | A | 10/1998 | Blevins | |
| 5,865,695 | A | 2/1999 | Mahala et al. | |
| 6,095,936 | A | 8/2000 | Kirkpatrick et al. | |
| 6,203,453 | B1 * | 3/2001 | Coddens | 473/450 |

* cited by examiner

*Primary Examiner*—Gene Kim
*Assistant Examiner*—M Chambers
(74) *Attorney, Agent, or Firm*—Hoffman, Wasson & Gitler, P.C.

(57) ABSTRACT

A shooting and training aid for basketball players to prevent interference of the non-shooting hand when shooting a basketball. This interference is caused by the non-shooting hand unnecessarily providing force for the shot as well as the fingers on the non-shooting hand dragging on the side of the ball. The shooting and training aid is provided with several adjustable members which ultimately would wind around the arms of the non-shooting hand, include a loop attached to the base of the thumb of the non-shooting hand as well as a pocket member into which at least the tip of the middle finger of the non-shooting hand is inserted.

14 Claims, 5 Drawing Sheets

SHOOTING AND TRAINING AID FOR BASKETBALL PLAYERS

FIELD OF THE INVENTION

The present invention pertains generally to a shooting and training aid for basketball players. More particularly, the invention relates to a shooting and training aid which is adapted to be worn by the non-shooting arm and hand of a basketball player, for the purpose of developing a proper basketball shot and therefor increasing shooting percentages.

BACKGROUND OF THE INVENTION

As most basketball players and basketball fans realize, the most accurate method of shooting is utilizing a one hand push or jump shot. The function of the shooting hand in the one-handed shot is to provide guidance and force to direct the ball on a path toward the basket. The roll of the non-shooting hand is to help catch the ball and to stabilize it during the shooting motion. At the point of release, the non-shooting hand simply straightens and completely releases from the ball to enable the shooting hand to properly direct the basketball toward the basket. A universal problem shared by novice players, high school players, college players and even professional basketball players is the inevitable interference of the non-shooting hand as it is released from the basketball which would interfere with the shooting hand to properly direct the ball toward the basket in an accurate manner. This problem is often called "off-hand interference". Generally speaking, there are two types of off-hand interference. The first type of off-hand interference results from the off-hand providing an unneeded force to the ball thereby resulting in an inaccurate shot. This problem was rectified by the shooting aids described in U.S. Pat. Nos. 4,919,425 and 5,228,682, both patented by the applicant of the present invention. These patents both describe a training aid to be applied to the non-shooting hand of the basketball player. One or more band members are secured to the non-shooting hand between the elbow and the shoulder. A strap would extend from one of the bands and would include a loop member secured around the base of the thumb of the non-shooting hand. This aid would eliminate the problem of the non-shooting hand providing force to the ball. A second problem, not solved by U.S. Pat. Nos. 4,919,425 and 5,228,682 is the problem of the fingers on the non-shooting hand dragging on the side of the basketball. The present invention is directed to alleviating this problem.

Additional training and shooting aids for basketball are generally known in the prior art. Such devices, however, are typically directed to assisting the shooting arm to learn the proper shooting technique, and are often complex and cumbersome. For example, U.S. Pat. No. 4,383,685, which issued to Bishop, discloses a training aid for basketball players including a vest to be worn by a player and a curved guide bar pivotally mounted on the vest. An elastic sleeve worn on the elbow of the player's shooting arm is provided with a carriage and moves along the guide bar to direct the player's shooting arm in a curved path, thereby producing the proper shooting motion for a basketball.

U.S. Pat. No. 3,820,783, issued to Caveness teaches a basketball training aid which is intended to indicate the proper height to which a player's elbow should be raised in the shooting process. This patent includes a belt-supported bracket having an upwardly and forwardly extending arm provided at its upper end with a transverse gage bar for indicating the preferred height in which the player's elbow should be elevated. A guide bar which depends from the gage bar indicates a preferred lateral position for the player's elbow. The components of the device are relatively adjustable.

Although it is known in the prior art to provide means for discouraging the use of the non-shooting arm and hand in teaching the proper methods of shooting baskets, this is often done in an indirect manner. For example, U.S. Pat. No. 4,377,284, issued to Okerlin is directed to a basketball training device which inhibits the utilization of both arms while shooting by restricting the movement of the player's elbows. This device maintains the player's elbows in close proximity to each other as the ball is cast toward the basket. The device comprises a pair of stretchable sleeves adapted to be worn over the forearm of the non-shooting and shooting arms adjacent to the player's elbow. The sleeves are interconnected by means of a stretchable member which resists parting movement of the elbows.

Similarly, U.S. Pat. No. 4,579,341, issued to Furr restrains the elbow of the player's shooting arm by means of an L-shaped arm guide member connected to a support member which is secured to the back of a body harness worn around the torso of a player.

The prior art also generally teaches a variety of means for the proper placement of a player's hand upon the basketball. For instance, U.S. Pat. No. 3,707,730, issued to Slider discloses a basketball practice glove including thumb and finger portions, as well as palm, back and wrist portions. The palm portion spaces the player's palm from the basketball, while an adjustable strap between the thumb and index finger portions limits the extent to which these fingers can be separated. A stay provided on the back portion limits bending motion of the player's wrists. The glove is intended to cause the player's shooting hand to assume a cup-like shape so that the ball is controlled by the tips of the thumb and the fingers.

U.S. Pat. No. 3,640,532, issued to Bauer comprises an elongated flexible tube secured to the palm of the player's hand by means of an elastic loop for the purpose of preventing the basketball from touching the palm. Auxiliary straps extending between the fingers of the player's hand keep them separated for proper handling of the ball.

U.S. Pat. No. 3,858,876, issued to Williams teaches providing a basketball with visible and/or tactile markings, recess lines, areas etc. corresponding to the correct placement of the hands and fingers upon the basketball.

U.S. Pat. No. 6,203,453, issued to Coddens does describe a basketball training device for controlling and training a user's shooting form. A first embodiment of this device is illustrated in FIG. 2 includes a strap 10 encircling the user's torso and a strap 20 made from elastic material encircling the user's shoulder of its non-shooting hand. It is noted that the strap 10 and the strap 20 are connected to one another. The strap 20 is secured to a first loop 30 adapted to surround the user's thumb of the non-shooting hand and a second loop 40 adapted to surround the user's index finger of the non-shooting hand. However, as illustrated in FIG. 2, the Coddens' device does not allow the shooter to utilize the non-shooting hand to assist in the control of the ball until its point of release. It is apparent that at the point of release of the ball as illustrated in FIG. 3, the non-shooting hand is not even close to the basketball, as the basketball is released from the shooting hand. Consequently, the ball in the Coddens' design would travel a much longer distance with only the shooting hand providing control. This condition would have two negative consequences. Firstly, defenders would find it very easy to deflect the ball from the shooter's hand. This often happens close to the basket where conditions are very crowded. Secondly, players with smaller hands would find it difficult to maintain control of the ball.

Furthermore, it is noted that the Coddens' design includes a loop around the base of the index finger of the non-shooting hand. Even if this device would allow the non-shooting hand to extend close to the point of release, all four fingers, the index finger, the middle finger as well as the fourth and fifth finger can still interfere with the accuracy of the shot by allowing these fingers to drag on the ball. This is due to the fact that the fingers can still bend and form to the curvature of the ball. Finally, it is important to note that this loop is provided around the index finger and not the middle finger of the non-shooting hand. It is the middle finger that sends the strongest neurological message to the non-shooting hand and adjacent fingers to pull away and straighten, thereby eliminating any drag interference on the side of the ball that would cause shooting inaccuracy.

BRIEF SUMMARY OF THE INVENTION

The deficiencies of the prior art are addressed by the present invention which is directed to a shooting and training aid applied to the non-shooting arm and hand of a basketball player. A non-stretchable band member is applied to the player's non-shooting arm slightly above the elbow. One end of a non-stretchable strap member is connected to the band member. The second end of the strap member terminates in a loop designed to encircle the base of the thumb of the non-shooting hand of the basketball player. Therefore, this strap member would then extend from the band member to its termination with the aforementioned loop. A second strap member is affixed to the non-shooting strap member slightly above the termination loop, and is provided with a pocket member designed to be applied to the middle finger of the non-shooting hand of the player. The pocket member is applied to the top of the middle finger, and extends to approximately the middle knuckle of the middle finger.

When properly applied to the non-shooting arm and hand of the player, the shooting and training aid would allow the shooter to gain accuracy in his or her shot by eliminating a misapplied force provided by the non-shooting hand as well as preventing the fingers of the non-shooting hand from dragging on the side of the ball. As previously indicated, it is generally accepted that the most accurate method of shooting is by a one hand push shot or jump shot. In both of these situations, the shooting hand and arm would be used to predominantly control the flight of the basketball as well as to force the basketball on its way to the basket. Although this is the case, the non-shooting hand must provide some assistance in ensuring that the shot is accurately sent toward the basket in game situations. It is the role of this non-shooting hand to assist or gain control of the ball while it is caught and then move to a position where it is finally sent on its way to the basket. The best position for the ball to be released is at a level higher than the head. As the ball is raised into this position, it is important that the non-shooting hand and fingers remain in contact with the ball with the fingers curved around the curvature of the ball in order to supply maximum control. At the release point, when the ball is sent on its way to the basket, the non-shooting hand would move slightly away from the basketball and its fingers would straighten so as not to interfere with the ball when it is propelled solely with the force delivered by the shooting hand. It is at this release point that the aforementioned mistakes are made by the non-shooting hand to cause an inaccuracy of the shot, i.e. the non-shooting hand would help provide force to propel the ball toward the basket and the non-shooting hand would not pull away from the ball in a manner to cause drag on the side of the ball. During a perfect one-hand release, the final contact with the ball is best made by the index and middle finger of the shooting hand, with no force imparted to the ball by the non-shooting hand.

The present invention counteracts the two inaccuracy mistakes by restraining the thumb from pushing in a vertical plane. It also restrains the wrist from rotating inward in a horizontal plane. Horizontal wrist movement would allow the thumb to generate force as well as allowing the heel of the hand to generate some force. The present invention does not allow the non-shooting arm to fully extend. As this non-shooting arm does extend as it nears the point where the ball is released, the strap member which serpentines around the arm and attaches to the thumb would become tighter. As it tightens, it places a stronger pull on the thumb and the middle finger due to the fact that the middle finger is in the pocket member which in turn is attached to the second strap member. When the pull is strong enough, force is exerted on the tip of the middle finger to straighten it. This straightening action serves as signals to the non-shooting hand and the remaining fingers that are curved around the ball to straighten and pull slightly away from the ball. When adjusted properly, this action occurs just before the ball is propelled toward the basket by the shooting hand. It is important that the force exerted on the middle finger be such that it is pulled straight back. This is best accomplished by threading the second strap member through an attachment loop provided close to the thumb loop of the first strap member. Because this second strap member lays tight across the wrist of the non-shooting hand, the force placed on the middle finger is initiated close to the back of the hand and at a precise angle so as to pull the finger straight back. This is accomplished by having the attachment loop placed at a precise location and angle with respect to the thumb loop and the first strap member.

BRIEF DESCRIPTION OF THE DRAWINGS

These and other objects, features and many of the attendant advantages of the present invention will be better understood upon a reading of the following detailed description when considered in conjunction with the accompanying drawings wherein like parts of each of the several figures are identified by the same reference number, and wherein.

DESCRIPTION OF THE PREFERRED EMBODIMENT

Figure 1:
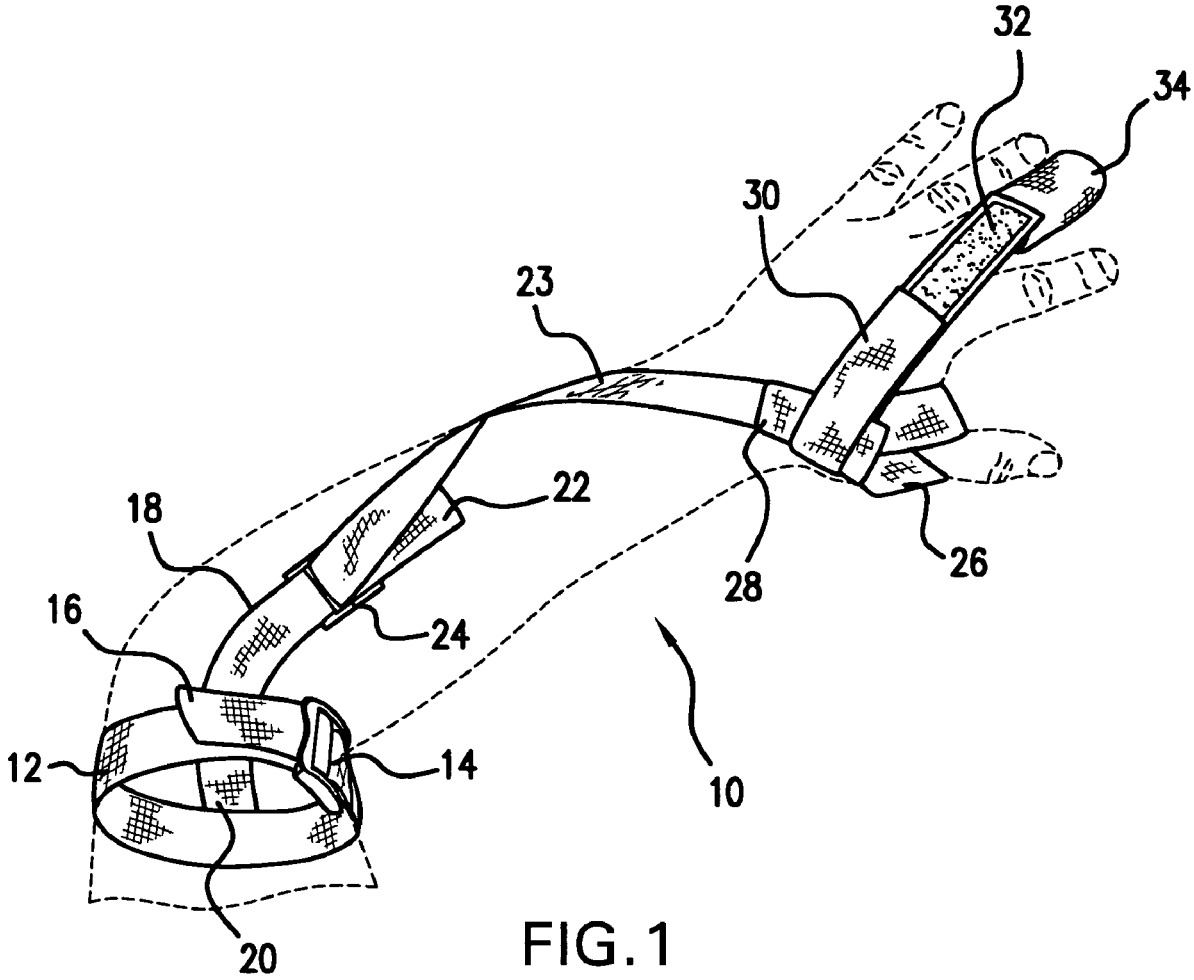
FIG. 1 shows a perspective view of the shooting and training aid as it appears when assembled upon the non-shooting arm and hand of a basketball player.
Figure 2:
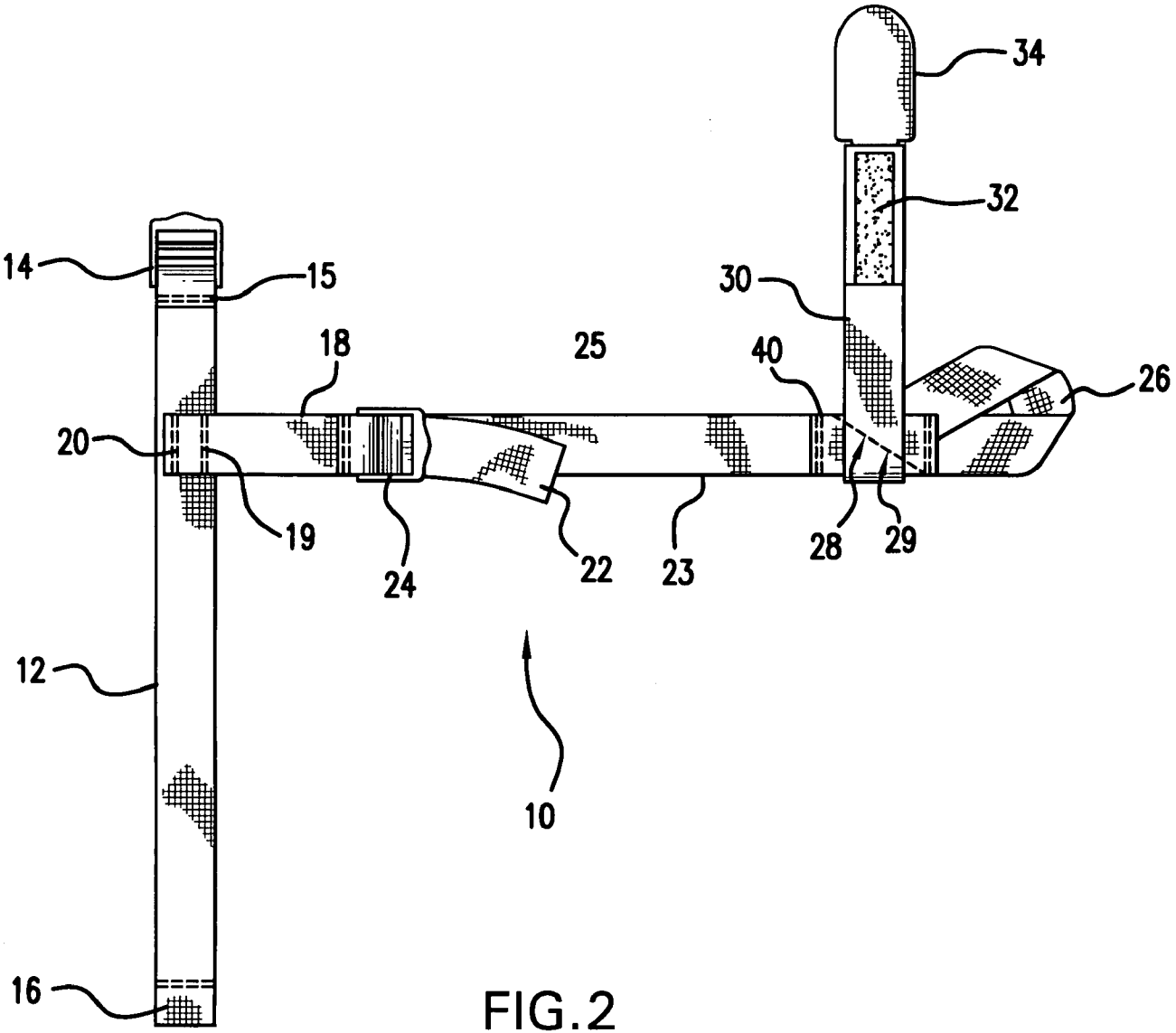
FIG. 2 is a plan view of the training and shooting aid.
Figure 3:
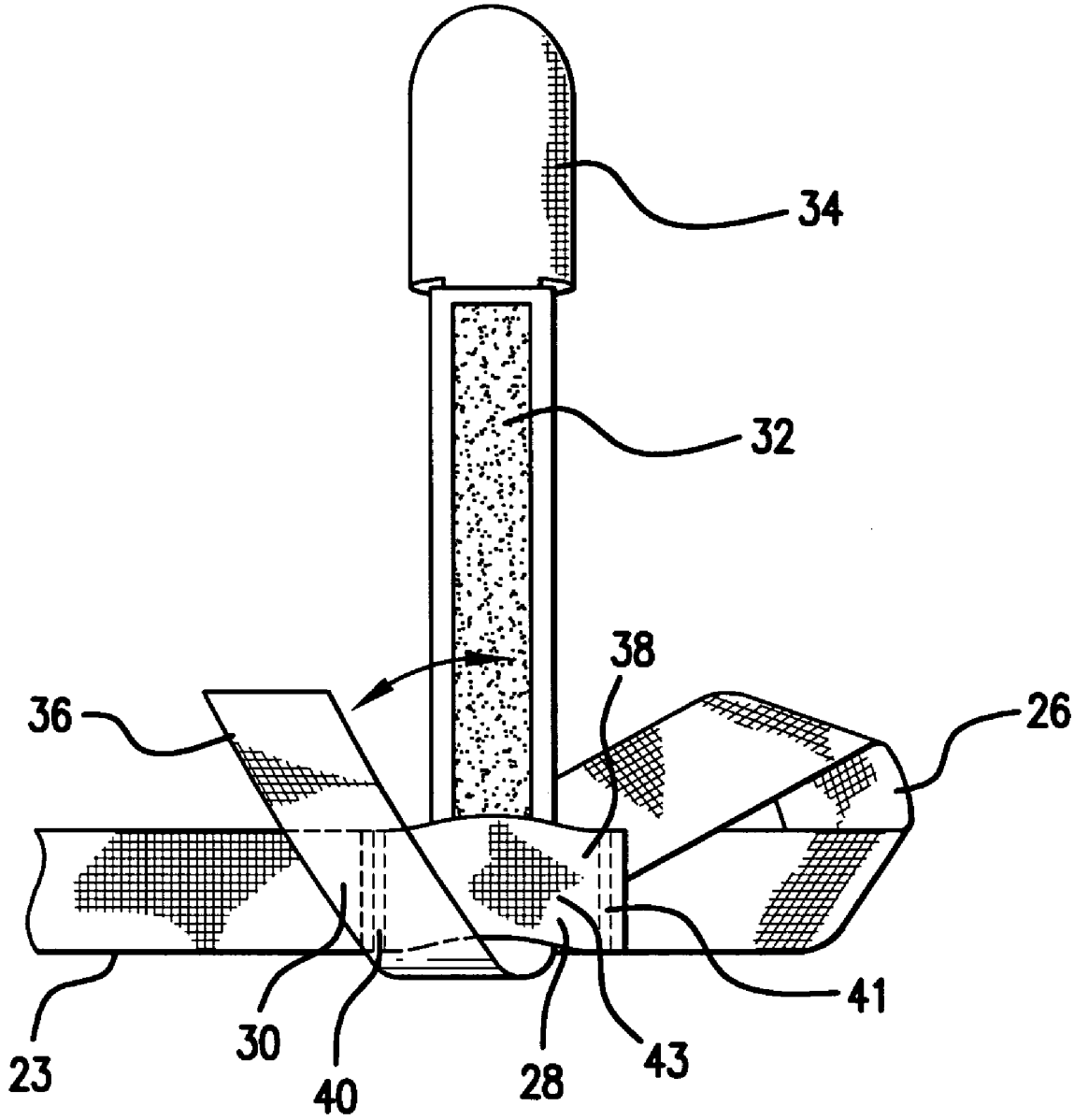
FIG. 3 is a plan view of the portion of the training aid to be applied to the middle finger of the non-shooting hand.
Figure 4:
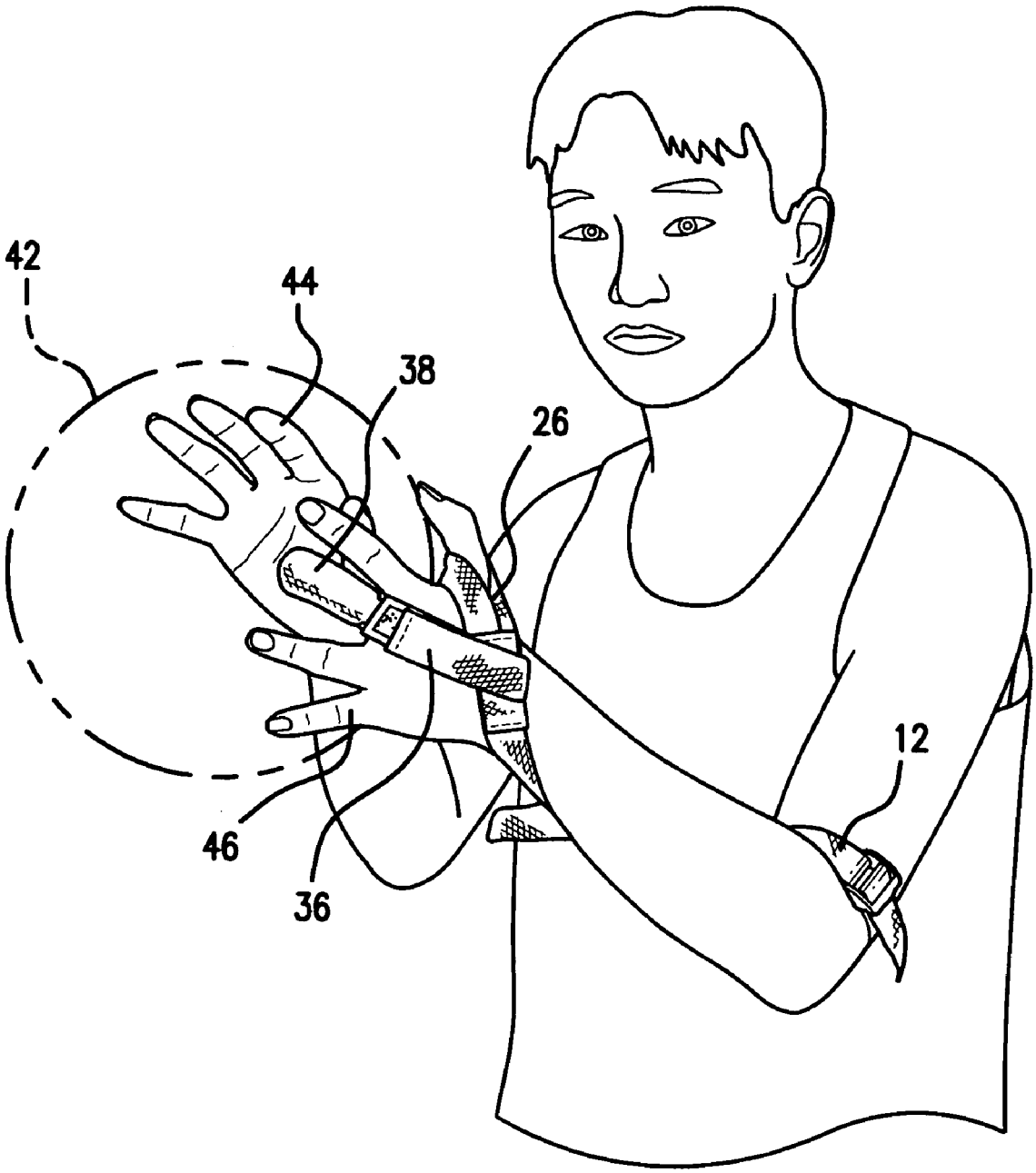
FIG. 4 is a perspective view showing the use of the training and shooting aid prior to entering a shooting motion.
Figure 5:
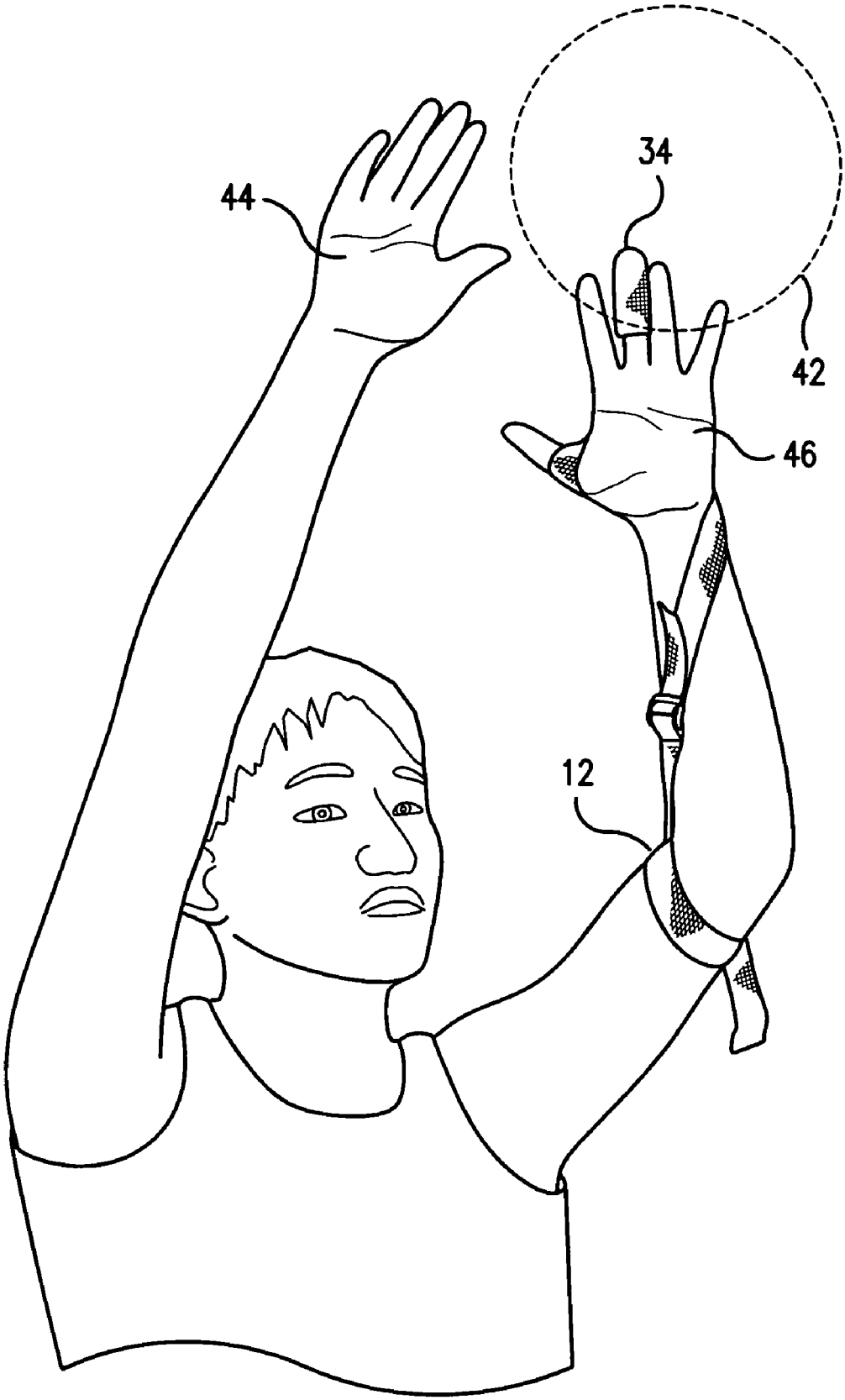
FIG. 5 is a perspective view of the training and shooting aid immediately after a basketball has left the shooting hand.

With reference to the drawings, particularly with respect to FIGS. 1-3, the shooting and training aid 10 is depicted. This shooting and training aid 10 includes a first band member 12 fabricated of non-stretchable material, preferably one-inch width cloth material provided with first and second ends 15 and 16, respectively. Attached to the end 15 of the first band member 12 would be a buckle-like affixing device 14. As shown particularly in FIG. 1, end 16 of the first band member 12 is designed to pass through the buckle 14, thereby forming a circular loop adapted to encircle the non-shooting arm of the basketball player, slightly above the elbow. The use of the buckle 14 would allow the basketball player to adjust the fitting of the first band member 12 just above the elbow to allow for the first band member 12 to be snugly assembled around the arm of the basketball player as depicted in FIGS. 1, 4 and 5. Although the figures depict the utilization of a buckle 14, any type of fastening device, allowing the first band member 12 to be adjusted when it passes through the buckle 14 to allow for a snug fitting for various sizes of arms is contemplated. Other types of securing devices would include a pair of (D) rings, hook and loop fasteners, or the like.

A first strap member 25 consisting of second and third band members 18 and 23 is transversely secured to the first band member 12 at one end 20. Although any means of attachment between the first band member 12 and the second band member 18 could be utilized, the present invention does employ fixedly attaching end 20 of the second band member 18 to the first band member 12 through the use of stitching 19. Similar to the first band member 12, the second band member 18 is preferably fabricated from a non-stretchable material, such as a one-inch width cloth material.

The third band member 23 is also preferably fabricated from a non-stretchable material, such as a one-inch width cloth material. This third band member 23 includes a first end member 22, and a second end member 28 fixedly attached to the third band member 23. A loop 26 is formed between the first end member 22 and the second end member 28 and is attached to the third band member 23 through the use of stitching 29. The stitching 29 is angled as it is secured to the third band member 23 as shown in FIG. 2. The third band member 23 is removably attached to the second band member 18 through the use of any type of standard attachment means, such as buckle 24. In this manner, the first end 22 of the third band member 23 would be threaded through the buckle 24, allowing the effective distance between the second band member 18 and the loop 26 to be altered, allowing for differences in the physiology of the basketball shooter. This is important since the thumb of the non-shooting hand of the basketball player 26 would pass through the loop 26 in such a manner so that it is situated near the base of the thumb. Therefore, the adjustability of the second and third band members with respect to one another is important to the operation of the present invention. Once the correct distance has been established between the end 20 of the second band member and the loop 26, the buckle 24 would maintain this distance during use.

A second strap member 30, also fabricated from a non-stretchable material such as a one-inch cloth is transversely attached to the third band member 23. The second strap member 30 is provided with a first end 32 and a second end 36. As shown in FIG. 3, one surface of the first end 32 of the fourth band member 30 is provided with hook material and the opposing end of second end member 36 is provided with loop material, thereby creating a hook and loop attachment means between ends 32 and 36, thereby securing these ends together. As can be appreciated, it is immaterial to which end 32 or 36 the respective hook and loop type of fasteners are affixed, just as long as one end 32 has one type of fastener applied thereto and the second end 36 has the opposite type of fastener applied thereto. A pocket member 34 is fixedly attached to the first end 32. The middle finger of the non-shooting hand is adapted to be inserted into the pocket 34. Generally, the pocket member is applied to the tip of the middle finger, and extends to approximately the middle knuckle of the middle finger. This pocket member 34 can be constructed from material that stretches to accommodate variable widths of fingers but shall not stretch lengthwise. The use of the hook and loop fastening device would allow for the distance between the pocket member 34 and a pocket portion 38 of the third band member 23 to be adjusted to insure that the middle finger of the non-shooting hand of the basketball player is properly positioned. This is accomplished by passing the second end 36 of the second strap member 30 through the pocket 38 attached to the third band member and properly adjusting the hook and loop fasteners accordingly.

The pocket portion 38 is a separate piece of one inch non-stretchable material that is fastened to the third band member 23. It is placed and stitched at a precise angle as to force the second strap member 30 to line up with the middle finger.

The pocket portion 38 is produced by applying a non-stretchable top portion 43 over a portion of third band member 23, just below the loop 26, to form a pocket. The pocket portion is attached to the third band member by stitches 40 and 41 at an angle to force the second strap member 30 to line up with the middle finger of the non-shooting hand.

Having described the configuration of the shooting and training aid, with reference to FIGS. 4 and 5, the manner in which the shooting and training aid is applied to the non-shooting hand of the basketball player, and how it is utilized during the shooting process will now be explained. Initially, the first end 16 of the first band member is passed through the buckle 14 to form a loop. Assuming, as is illustrated in the Figures, the training and shooting device is to be applied to the left hand and arm of the player, the looped first band member 12 is held in the shooting hand with the buckle 14 on the right side. The non-shooting hand is then inserted into the loop at a position slightly above the elbow until it is snugly attached to the non-shooting arm of the player, by pulling end 16 further through the buckle 14. At this point, the third band member 23 should be attached to the second band member 18 by inserting end 22 through the buckle 24. The third band member 23 is positioned serpentining around the middle of the arm as shown in FIG. 1, as well as going under the arm toward the thumb of the non-shooting hand. At this point, the end 22 of the third band member 23 is further pulled through the buckle 24 to tighten this band member with respect to the loop 26 provided around the base of the thumb of the non-shooting hand. The middle finger of the non-shooting hand is then inserted into the pocket member 34 of the fourth band member 30. The distance between the pocket 38 attaching the fourth band member 30 to the third band member 23 can be changed with respect to the tip of the index finger by changing the relationship between the hook and loop fastening members. Proper adjustment is made by first straightening all of the fingers of the non-shooting hand. The end 36 of the fourth band member is pulled toward the end of the middle finger until the tip of the middle finger is pulled back between ½ inch to 1 inch. At this point, the hook and loop fastening device is attached. Even though the middle finger would be pulled back, it can still bend to assist in holding the ball.

As depicted in FIG. 4, as the shooter begins his shooting motion by raising both his shooting hand 44 and his non-shooting hand 46, the fingers of the non-shooting hand 46 are curved around the basketball 42. FIG. 5 illustrates the position of both the shooting hand 44 and the non-shooting hand 46 immediately subsequent to the basketball 42 being released from the shooter's hand 44. When moving from the position shown in FIG. 4 to the position shown in FIG. 5, prior to the point of release, both arms of the basketball player must extend. As the non-shooting arm extends, the first band member 12, the second band member 18 and the third band member 23, including the loop portion 26 would begin to tighten and would restrain the non-shooting arm and non-shooting hand from providing force to the basketball 42. This tightening action also causes the second strap member 30 to straighten the middle finger and to pull it away from the basketball 42. When this action occurs, the remaining fingers would straighten, thus pulling away from the ball without those fingers exerting a force to nor a drag on the ball. The end result would be a perfect one-hand release with much greater accuracy.

Having described this new improved basketball training and shooting aid, it is believed that modifications, variations and changes will be suggested to those skilled in the art in light of the above teachings. It is, therefore, to be understood that all such variations, modifications and changes are believed to come within the scope of the invention as defined by the appended claims.

What is claimed is:

1. A basketball shooting and training aid to be applied to the non-shooting arm and hand of basketball players, comprising:

a first band member for attachment to the non-shooting arm of a basketball player at position between the basketball player's shoulder and elbow;

a first strap member having a first end attached to said first band member and a second end provided with a loop for encircling the base of the thumb of the non-shooting hand of the basketball player;

a second strap member attached to said first strap member at a position proximate to said loop; and a pocket member attached to said second strap member into which the middle finger of the non-shooting hand of the basketball player is inserted, wherein, as the non-shooting hand is extended during a shooting motion, said first band member, said first strap member, and said second strap member including said pocket member tighten, thereby providing the proper release from a basketball of the thumb, middle finger and remaining fingers of the non-shooting hand, during the shooting motion.

2. The basketball shooting and training aid in accordance with claim 1, wherein said first strap member comprises a second band member affixed to said first band member and a third band member connected to said second band member.

3. The basketball shooting and training aid in accordance with claim 1, wherein said first band member is provided with first and second ends and a first securing device attached to said first band member, said first end of said first band member passing through said first securing device to create a loop, allowing said first band member to encircle the non-shooting arm of the basketball player.

4. The basketball shooting and training aid in accordance with claim 2, wherein said first band member is provided with first and second ends and a first securing device attached to said first band member, said first end of said first band member passing through said first securing device to create a loop, allowing said first band member to encircle the non-shooting arm of the basketball player.

5. The basketball shooting and training aid in accordance with claim 3, wherein said first securing device is adjustable.

6. The basketball shooting and training aid in accordance with claim 4, wherein said first securing device is adjustable.

7. The basketball shooting and training aid in accordance with claim 2, further including a second securing device attaching said second band member to said third band member.

8. The basketball shooting and training aid in accordance with claim 4, further including a second securing device attaching said third band member to said fourth band member.

9. The basketball shooting and training aid in accordance with claim 7, wherein said second securing device is adjustable.

10. The basketball shooting and training aid in accordance with claim 8, wherein said second securing device is adjustable.

11. The basketball shooting and training aid in accordance with claim 2, wherein said first band member, said first strap member, said second strap member are constructed from non-stretchable material.

12. The basketball shooting and training aid in accordance with claim 2, further including a fourth band member attached to said third band member to form a pocket therebetween through which said second strap member passes.

13. The basketball shooting and training aid in accordance with claim 12, wherein said second strap member is provided with a third securing device.

14. The basketball shooting and training aid in accordance with claim 13, wherein said third securing device includes a hook and loop fastening device.

* * * * *